United States Patent [19]

Tanaka

[11] Patent Number: 4,505,565

[45] Date of Patent: Mar. 19, 1985

[54] DEVICE FOR DETECTING AGING OF DEVELOPER FOR AUTOMATIC FILM DEVELOPING APPARATUS

[76] Inventor: Hiroshi Tanaka, 29-20, Tenjincho-1-chome, Takatsuki-shi, Osaka, Japan

[21] Appl. No.: 450,550

[22] Filed: Dec. 16, 1982

[30] Foreign Application Priority Data

Dec. 22, 1981 [JP] Japan ..... 56-208755
Dec. 22, 1981 [JP] Japan ..... 56-208756

[51] Int. Cl.[3] ..... G03D 3/08

[52] U.S. Cl. ..... 354/299; 354/297; 354/320

[58] Field of Search ..... 354/298, 299, 320, 321, 354/322, 324, 297, 319; 204/1 T, 1 H, 400, 406, 433; 436/150

[56] References Cited

U.S. PATENT DOCUMENTS 3,388,652 6/1968 Parrent ..... 354/321
4,153,363 5/1979 Albano ..... 354/322
4,240,737 12/1980 Lawson ..... 354/299
4,284,343 8/1981 Junghanns ..... 354/324
4,295,913 10/1981 Purr et al. ..... 354/324
4,304,484 12/1981 Mizuta et al. ..... 354/321

FOREIGN PATENT DOCUMENTS 54-13962 6/1979 Japan .
54-27965 9/1979 Japan .
55-19944 5/1980 Japan .

*Primary Examiner*—A. A. Mathews
*Attorney, Agent, or Firm*—Wenderoth, Lind & Ponack

[57] ABSTRACT

A device for measuring the oxidation reduction potential of a developer for developing films to indicate the degree of aging of the developer on a meter. A control unit operates in response to the measurement output signal to automatically control the speed of development in accordance with the degree of aging of the developer.

3 Claims, 4 Drawing Figures

DEVICE FOR DETECTING AGING OF DEVELOPER FOR AUTOMATIC FILM DEVELOPING APPARATUS

BACKGROUND OF THE INVENTION

The present invention relates to an automatic film developing apparatus, and more particularly to an apparatus for treating exposed sensitized papers or photographic films continuously and full-automatically by the steps of development, fixing, washing with water and drying in sequence.

The developer for such a film developing apparatus progressively deteriorates or ages when used for developing films. The aging of the developer is caused by the film developing treatment or by oxidation which occurs when the developer is allowed to stand. When the developer ages owing to either of these causes, the oxidation reduction potential (hereinafter referred to as "ORP") drops. Accordingly, the degree of aging of the developer can be detected by measuring the ORP of the developer.

The aging of the developer gives an obscure finish to the developed film. If exposed films are developed with a developer which has aged beyond a limit, distinct images will not be obtained, with the likelihood that the subsequent treatment will involve a serious error. Such a failure is readily avoidable by following the required measures, such as replenishment of the developer, if the ORP value is detectable in advance. Furthermore when the degree of aging is within the limit, films can be developed to give clear images by adjusting the developing speed to a value in accordance with the degree of aging.

SUMMARY OF THE INVENTION

An object of the present invention is to provide a device for detecting the degree of aging of a developer and immediately displaying the result. Another object of the invention is to provide a device which is adapted to measure the degree of aging and indicate the result on a display and in which control means is operated with the output signal of the measurement to automatically adjust the speed of development in accordance with the degree of aging of the developer and to develop films properly at all times.

DETAILED DESCRIPTION OF THE INVENTION

Figure 1:
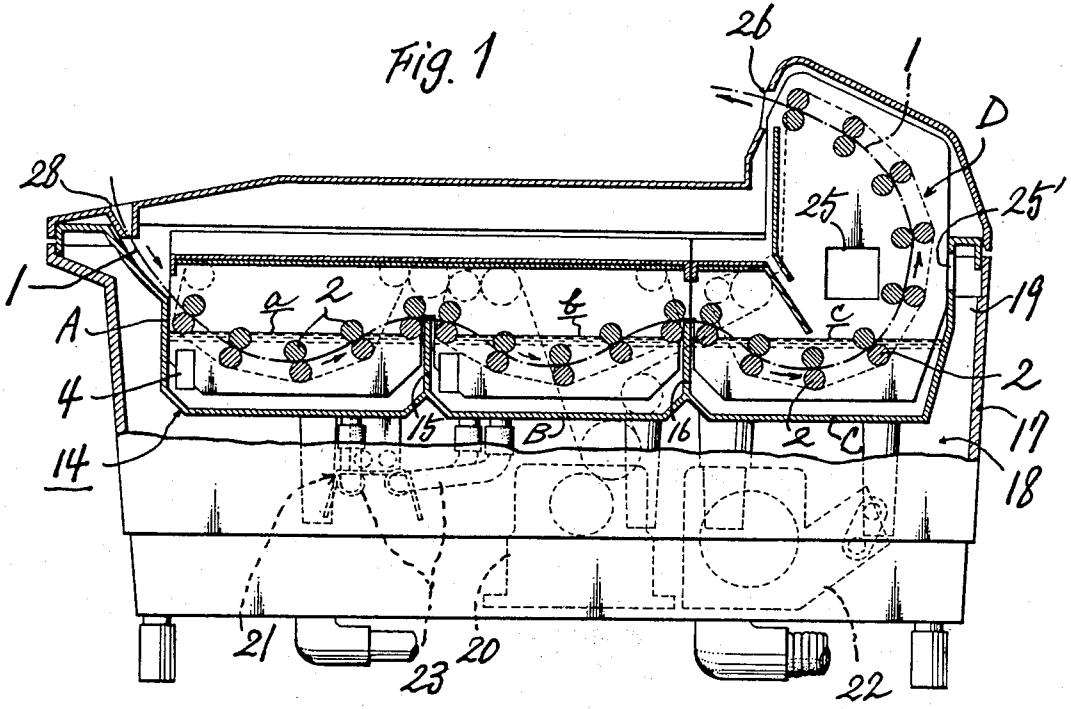
FIG. 1 is a side elevation in vertical section showing an automatic film developing apparatus equipped with a device embodying the invention.

FIG. 1 shows a full automatic developing apparatus by which films are developed, fixed and washed with water continuously. A bath container 14 is divided by partitions 15 and 16 into three compartments, namely, a developing compartment A, a fixing compartment B and washing compartment C, which contain a developer a, a fixing solution b and washing water c, respectively, without mingling. The container 14 is joined to a main body case 17 with a bottom space 18 and a peripheral space 19 provided therebetween. Arranged in the bottom space 18 are a drive unit 20 for driving feed rollers 2, a heater 21 for maintaining the developer and other liquids at a constant temperature, a blower 22 for drying a film 1 by forcing hot air against the film 1 forwarded after washing with water, etc. The heater 21 is provided with circulating pipes 23 connected to the bottom of the container for incessantly circulating and agitating the treating baths. The temperature of the baths is maintained by control means at a set level required for development.

The film 1 to be developed is inserted through a rear inlet 28, guided by the feed rollers 2 through the developer a, fixing solutions b and washing water c in the compartments, dried while passing through a drying section D by being exposed on its opposite surfaces to hot air forced out from air outlets 25, 25' and sent out from the apparatus through an outlet 26.

The device of this invention is incorporated into the above developing apparatus.

Figure 2:
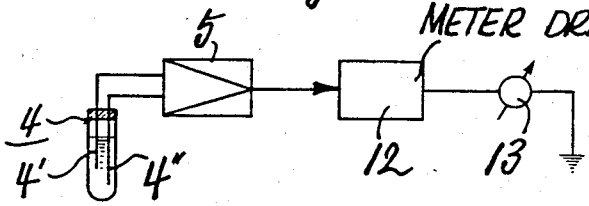
FIG. 2 is a block diagram showing the circuit of a first embodiment of the invention.

FIG. 2 shows a first embodiment of the invention. A potential difference generator 4, which is disposed in the developing compartment A, comprises a pair of electrodes including a detecting electrode 4' made of gold, platinum or other similar inactive material and a comparison electrode (also called a compensation electrode) 4'' of silver chloride for measuring the potential difference produced between the solution and the electrode, i.e., ORP. The detecting electrode 4' is immersed in the developer as directly exposed thereto, while the comparison electrode 4'' is immersed in a potassium chloride solution enclosed in a container lined with a thin glass coating.

When the aging of the developer proceeds, the degree of aging is detected by the potential difference generator 4, and the output is amplified by an amplifier 5. In FIG. 2, the amplified output is fed to a meter driving amplifier 12 to operate a meter 13 connected thereto. The degree of aging is shown by the deflection of the pointer of the meter. The scale on the meter may be colored stepwise in different colors, e.g., red, yellow and green, so that the variation of the ORP value, i.e., the degree of aging, can be observed easily in terms of color. The meter drive circuit can be connected to an actuating switch for an alarm buzzer or pilot lamp to give an alarm at the same time.

If the degree of aging of the developer is high but below a limit, films can be developed properly for the time being by reducing the speed of development through the adjustment of the film feed speed and/or by elevating the temperature of the developer from the usual level.

Furthermore if the temperature of the developer is lower than the proper temperature (usually 32° C.), the measurement afforded by the potential difference generator is low even when the developer has not aged (with a high ORP value).

Accordingly, at the initial stage of operation, the temperature of the developer is low, and the apparatus is not ready for the devoping process because of a low measurement, but in such an event, the operation is automatically controllable based on the relationship between the temperature measurement and the ORP measurement given by the generator.

Figure 3:
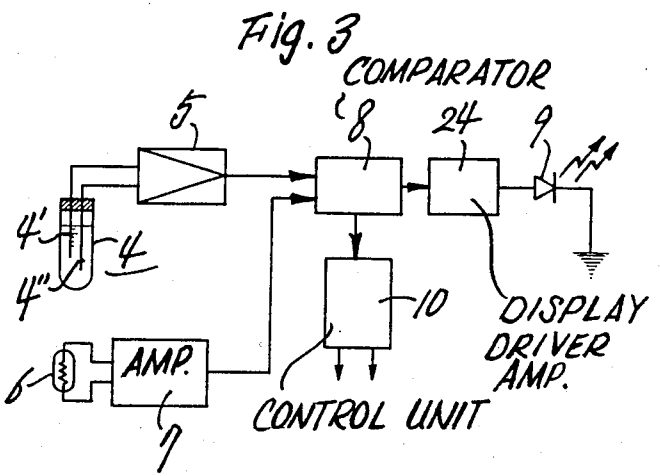
FIG. 3 is a block diagram showing the circuit of a second embodiment of the invention.

FIG. 3 shows an embodiment adapted for such automatic control. The embodiment includes the same potential difference generator 4 as in the first embodiment, a temperature sensor 6 for measuring the temperature of the developer and an amplifier 7 connected to the sensor 6. The sensor 6 comprises a thermistor or an IC temperature sensor.

When the temperature of the developer is measured by the sensor 6, the output signal is fed to a level comparator 8 via the amplifier 7. If the temperature is lower than the proper range, the temperature control means operates to elevate the temperature. The output from the generator 4 is fed to an amplifier 5, which gives an amplified output to the level comparator 8, in which the two outputs are compared. When they are within an allowable range, a display 9 comprising a pilot lamp or light emitting diode or the like is operated. At the same time, a control unit 10 operates in response to an output signal from the level comparator 8, giving an output signal to speed control means for the drive unit 20 for adjusting the speed of the film feed rollers 2. Thus, the output signal from the control unit 10 reduces the speed of the feed rollers 2 in accordance with the degree of aging. Indicated at 24 is an amplifier for the display 9.

Figure 4:
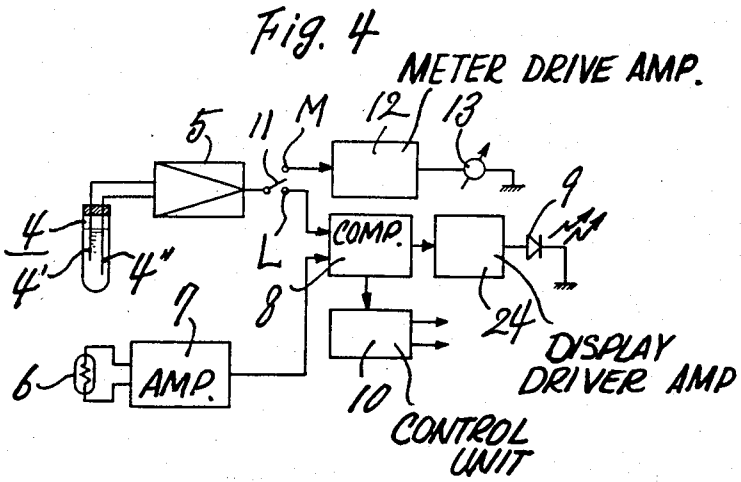
FIG. 4 is a block diagram showing the circuit of a third embodiment of the invention.

FIG. 4 shows a third embodiment comprising the combination of the first and second embodiments. This embodiment is adapted to show the degree of aging on the meter 13, or to show the degree of aging on the display 9 and to automatically control the developing speed by the control unit 10. Accordingly the embodiment includes a change-over switch 11 for selectively giving the output of the amplifier 5 to the meter driving amplifier 12 or to the level comparator 8. When the meter 13 only is operated, the switch 11 is closed at a contact M as seen in FIG. 4. In this case the output from the potential difference amplifier 5 is fed to the meter driving amplifier 12 to operate the meter 13 connected thereto so as to indicate the degree of aging by the deflection of the meter pointer as is the case with the embodiment of FIG. 2. When the switch 11 is closed at a contact L, the degree of aging if displayed and the developing speed is controlled in the same manner as in the second embodiment.

According to the present invention, the ORP of the developer is measured to detect the degree of aging thereof and accurately show the result on a meter, so that films can be developed properly at all times without failure. Furthermore the developer can be used effectively to assure economy.

Furthermore according to the invention, the ORP of the developer is measured to indicate the degree of aging on a display and operate a control unit with the resulting output signal so that films can be developed properly at all times at a speed automatically adjusted according to the degree of aging of the developer. Since the degree of aging is detected in relation to the temperature of the developer, the invention assures easy temperature control for the proper development of the film. Moreover, the invention can be reduced to practice with a device of simple construction.

What is claimed is:

1. In an apparatus for automatically continuously developing an exposed web of photosensitive material by passing said material through a developer with use of feed rollers, a device for detecting aging of said developer comprising a potential difference generator including an electrode which is inactive to the developer for measuring a potential difference between said developer and another electrode, said another electrode being immersed in said developer, a potential difference amplifier having inputs which are connected to said difference generator for amplifying said potential difference, and a meter connected to an output of said amplifier via a meter driving amplifier for indicating an oxidation reduction potential of said developer, said oxidation reduction potential corresponding to said measured potential difference and related to said ageing of said developer.

2. In an apparatus for automatically continuously developing an exposed web of photosensitive material by passing the material through a developer with use of feed rollers, a device for detecting aging of said developer comprising a potential difference generator including an electrode which is inactive to said developer and another electrode, said another electrode being immersed in said developer, a potential difference amplifier having inputs which are connected to said difference generator for amplifying said potential difference, a temperature sensor for measuring a temperature of said developer, a temperature sensor amplifier connected to said sensor for amplifying a sensor output, a level comparator connected to said difference and sensor amplifiers for comparing outputs from said two amplifiers and for providing an output when said outputs are within an allowable preset range, and a display means and a developing speed control unit connected to said output of said level comparator and operable in accordance with said output of said comparator.

3. A device as defined in claim 2, further comprising a change-over switch connected between an output of said potential difference amplifier and an input of said level comparator and also connected to a meter via a meter driving amplifier for indicating the oxidation reduction potential of said developer, said oxidation reduction potential corresponding to said measured potential difference and related to said ageing of said developer; wherein said switch selectively alternatively connects said difference amplifier output to said meter driving amplifier or to said level comparator input.

* * * * *